US006240697B1

(12) United States Patent
Thompson et al.

(10) Patent No.: US 6,240,697 B1
(45) Date of Patent: Jun. 5, 2001

(54) THREADED ANCHOR FOR POURED CONCRETE METAL DECK FLOORS AND WOOD FRAME FLOORS

(76) Inventors: William J. Thompson, 11 Hillsborough, Newport Beach, CA (US) 92660; Keith L. Watkins, 22600 Hidden Hills Rd., Yorba Linda, CA (US) 92887

( * ) Notice: Subject to any disclaimer, the term of this patent is extended or adjusted under 35 U.S.C. 154(b) by 0 days.

(21) Appl. No.: 09/525,421

(22) Filed: Mar. 15, 2000

(51) Int. Cl.[7] ..... G04C 5/12
(52) U.S. Cl. ..... 52/698; 82/704; 82/707
(58) Field of Search ..... 52/795, 698–705, 52/706, 207; 411/82; 405/259.5, 259.6

(56) References Cited

U.S. PATENT DOCUMENTS 991,517 * 5/1911 Kennedy ..... 411/82
2,687,788 * 8/1954 Rapp ..... 52/704 X
2,689,987 * 9/1954 Berger ..... 52/295 X
3,405,497 * 10/1968 McNair ..... 52/704 X
4,945,704 * 8/1990 Brown, Jr. ..... 52/704 X
5,568,711 * 10/1996 Popp et al. ..... 52/704
5,628,161 * 5/1997 Giannuzzi et al. ..... 52/699 X

* cited by examiner

*Primary Examiner*—Richard Chilcot
(74) *Attorney, Agent, or Firm*—Price and Gess

(57) ABSTRACT

An internally threaded insert anchor for use in poured concrete floors having a metal decking or a wood form is described which provides stability against skewing or misalignment due to rough action after being inserted into the metal deck or wood form, prior to the concrete being poured. Once locked into the concrete floor, the threaded insert anchor provides easy attachment for the support rods that carry the racks of utility, piping and ceiling grid systems for the building. Each threaded insert anchor is capable of accepting two different size rods or bolts with different thread cuts. The internal threaded apertures are protected from concrete intrusion during the pour by the plastic or metal sleeve. Moreover, the anchors are designed so that subsequent spraying of the ceiling with fire retardant or insulation foam will not penetrate into the threaded apertures, so as to prevent subsequent entry of the support rods.

10 Claims, 2 Drawing Sheets

THREADED ANCHOR FOR POURED CONCRETE METAL DECK FLOORS AND WOOD FRAME FLOORS

BACKGROUND OF THE INVENTION

1. Field of the Invention

The present invention relates generally to improvements in anchors for poured concrete metal deck and wood framed floors in multi-story buildings, and more particularly pertains to new and improved threaded anchors that are inserted into the poured concrete metal deck or wood framed floors prior to pouring of the concrete so that when the concrete is set, these anchors may be used as support points for suspended utilities such as plumbing, mechanical piping, mechanical equipment, cable trays, bus ducts, HVAC ducts, electrical conduit, conduit racks, junction boxes and panels for example.

2. Description of Prior Art

In the field of anchors for concrete wood form and concrete metal deck floors, it has been the practice to utilize a threaded stud with a plate attached to its body, or an elongated nut with a bolt threaded into one end with a plate attached to its body to provide suspension points for support rods that suspend the utilities and utility racks that traditionally hang from the ceiling, which is the poured concrete floor of the floor above.

FIG. 1 illustrates a prior art anchor 11 which consists of threaded bar stock or a stud 15 bent at a right angle having an elongated plate 13 with apertures 17 at each end fastened to it. The threaded anchor 11 is placed into an aperture 18 drilled into a metal deck 21 which may have a general corrugated shape as illustrated in FIG. 2. The right angle bend of the threaded stud 15 is on top. The other end of stud 15 is inserted through the aperture 18 with a nut 19 threaded onto that end to pull the elongated plate 13 tight against the metal deck 21. Once the installation of all the anchors 11 is complete on the floor of a building, concrete 23 is poured over the metal deck 21, to the required thickness, holding the threaded stud 15 in place. The threaded end of steel 15 descending through the floor 21 is actually descending from the ceiling of the floor above. Suspended utility structures are attached to this end of the stud 15.

FIG. 3 illustrates an alternate prior art embodiment of an anchor for poured concrete metal deck or wood frame floor. This alternate prior art anchor 25 comprises a bolt 27 having a nut 33 threaded thereon. The portion of the bolt below nut 33 passes through an aperture in a plate 29 having a pair of fastening holes 31 on opposite ends thereof. The threaded end portion of the bolt 27 which passes through the aperture in the plate 29 has an elongated nut 35 threaded on to it. The other end 37 of the elongated nut 35 is left open for reception of a threaded support shaft. This type of prior art threaded anchor provides for ready attachment of a threaded shaft thereto. Whereas, the anchor of FIGS. 1 and 2 require the further use of a female coupler nut on threaded shaft 15, if a threaded support shaft were to be attached to it. In both cases, the size of the support shaft that may be used is determined by the anchor inserted into the floor prior to the pour.

The size of the support rods utilized will vary as dictated by load requirements depending upon the kind of utilities that are being suspended. Thus, once the prior art anchors are in place, the size of the suspension rods cannot be changed. Moreover, these prior art threaded anchors require a considerable amount of labor per device to install. These problems are overcome by the threaded anchors of the present invention.

SUMMARY OF THE INVENTION

Two embodiments of the internally threaded concrete insert anchor invention are disclosed, one designed for use with steel deck poured concrete floors, and one designed for wood form poured concrete floors. The internally threaded anchor for steel deck poured concrete floors is designed to snap-fit into holes drilled or punched into the steel deck. The anchor has a head with a shaft attached which is internally threaded at two different diameters to selectively accept two different size threaded support rods. A large washer or plate rides on the shaft and is separated from the head by a spring. A plastic or metal tube with a set of expanded plastic fingers is attached to the shaft on the other side of the plate. The threaded anchor is inserted into the hole in the deck with its head up causing the fingers to fold allowing the shaft to pass through the hole up to the plate which is being pushed down the shaft by the spring. The threaded anchor is held upright in the hole of the steel deck by the expanded fingers on one side of the deck and the plate against the other side of the deck, being squeezed together by the spring. The plastic or metal tube secures the underside of the threaded insert anchor prior to the concrete pour and provides thread protection from debris and proper rod guidance and alignment after the concrete has been applied.

The threaded anchor for wood form poured concrete floors has a head attached to a shaft that is internally threaded for two different size threaded studs. A plastic plate is attached to the outside of the shaft. The plate carries a plurality of bosses, each boss holding a nail aligned with the head and shaft of the threaded anchor. The threaded anchor is nailed into the wood form floor prior to the concrete pour.

BRIEF DESCRIPTION OF THE DRAWINGS

The exact nature of this invention as well as its objects and many of the attendant advantages of the invention will be readily apparent as the invention becomes better understood upon consideration of the following detailed description in relation to the accompanying drawings in which like reference numerals designate like parts throughout the figures thereof and wherein.

DETAILED DESCRIPTION OF THE PREFERRED EMBODIMENTS

Figure 4:
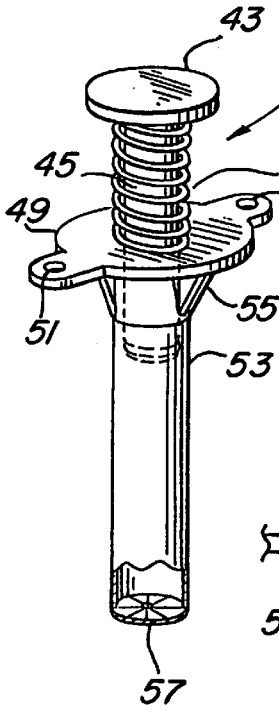
FIG. 4 is a perspective of a threaded anchor according to the present invention.

FIG. 4 illustrates a preferred embodiment of a threaded anchor of the present invention which is designed for use with a poured concrete metal deck. The threaded anchor 41 has a shaft 45 with a head 43, preferably enlarged and flat at a first end. The other end of the shaft 45 is inserted through an aperture 60 in a flat plate 49 which preferably has a pair of mounting holes 51 located at opposite ends of its periphery. The plate 49 is free to move up and down the shaft 45. Located on the shaft 45, between the head 43 and plate 49 is a compression spring 45. A plastic sleeve 53 is held firmly in place on the body of the shaft 45 on the side of the plate 49 opposite to the head 43, by press fit. Sleeve 53 may be made out of plastic, nylon or metal, for example. At a first end of sleeve 53 a series of expanded slits to create a series of fingers 55 around its perimeter which abut against the underside of the plate 49. The second end of sleeve 53 contains an aperture 57 with a cover 57, which is serrated providing a closure that parts upon the insertion of a threaded rod. The plate 49 may be made from a variety of material like steel, plastic, or nylon derivatives, for example. The plate 49 is preferably at least 50% greater in diameter than the access hole 62 in the metal deck, through which the second end of shaft 45 and sleeve 53 passes.

Figure 1:
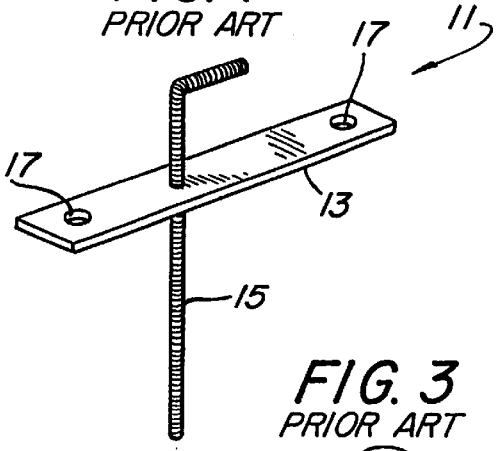
FIG. 1 PRIOR ART
FIG. 1 is a perspective of a prior art threaded anchor.
Figure 2:
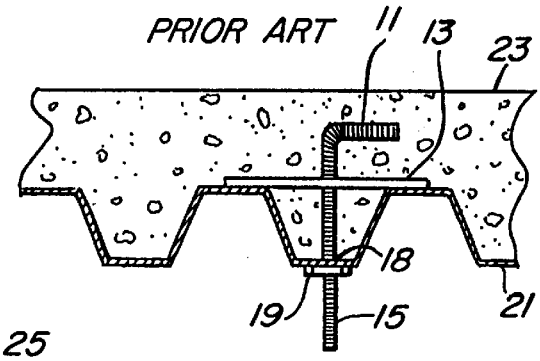
FIG. 2 PRIOR ART
FIG. 2 is an elevation of a threaded anchor in place in a metal deck floor after a concrete pour.
Figure 3:
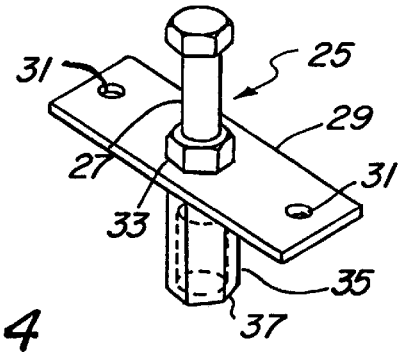
FIG. 3 PRIOR ART
FIG. 3 is a perspective of an alternate threaded anchor of the prior art.
Figure 5:
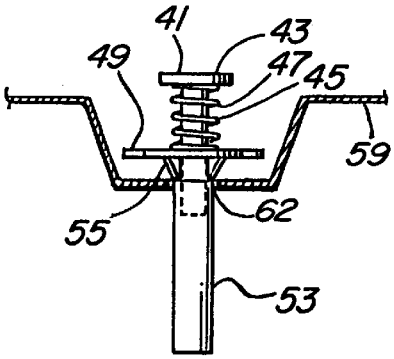
FIG. 5 is an elevation of the threaded anchor of FIG. 4 being placed into a metal deck.

Referring to FIG. 5, insertion of the threaded anchor 41 is illustrated. The second end of the threaded anchor which includes the sleeve 53 is inserted through an aperture 62 in the metal deck 59 and forced downward, causing the expanded fingers 55 to contract and pass through aperture 62 of the metal decking 59 to the other side of the metal decking 59, leaving the plate 49 on the opposite side. The spring 47 applies a force to squeeze metal decking 59 between plate 49 and expanded fingers 55, causing the shaft 45 to be held upright. Moreover, if a temporary force tends to move shaft 45 from its vertical, spring 47 will bring it back to vertical as a result of forces being applied between plate 49 and expanded fingers 55.

Such forces can be expected on a construction site until a concrete 61 covers the anchor and metal deck 59. The spring 45 is designed to withstand the pouring forces as well, thereby keeping the shaft 45 at its vertical at all times. A preferred embodiment of the spring is made from oil tempered M.B wire, music wire, or stainless steel.

Figure 7:
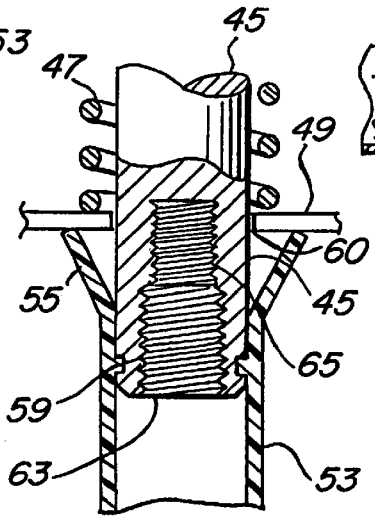
FIG. 7 is a partial cross-section of the shaft of the threaded anchor of FIG. 4.
Figure 6:
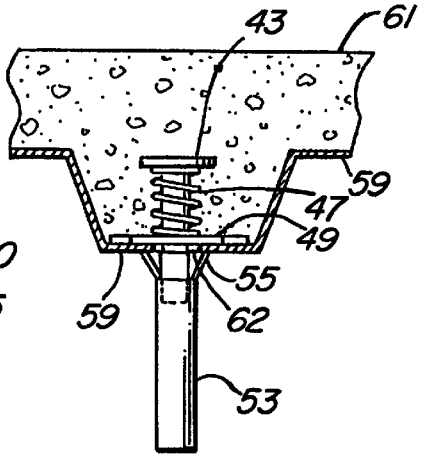
FIG. 6 is an elevation showing the threaded anchor of FIG. 4 in place in a metal deck floor after a concrete pour.

Refer now to FIG. 7 which illustrates the internal aperture of the shaft 45 extending from the second end 63. Two threaded apertures are illustrated, a smaller threaded aperture 65 located internal to a larger threaded aperture 59, which opens to the second end 63. Although only two different size threaded apertures 65 and 59 are illustrated, it should be understood that more than two may be utilized. Preferably, the dimensions of the threaded apertures 65 and 59 are paired, with aperture 65 at a ⅜" diameter, threaded aperture 59 would be a ½" diameter. If threaded aperture 65 was at ⅝" diameter, threaded aperture 59 would be at ¾" diameter.

Once the threaded anchor 41 is installed, and the concrete 61 poured over the metal decking 59, threaded anchor 41 is capable of receiving a ⅜" threaded rod or a ½" threaded rod if a different size anchor is used, a ⅝" threaded rod or a ¾" threaded rod. The flexibility thus provided by allowing the size of the support rod to be changed after installation of the anchors, along with the ease of installation of the anchor 41 itself, simply popping it through the aperture 60 in the metal plate, is a considerable improvement over prior art anchors.

Figure 8:
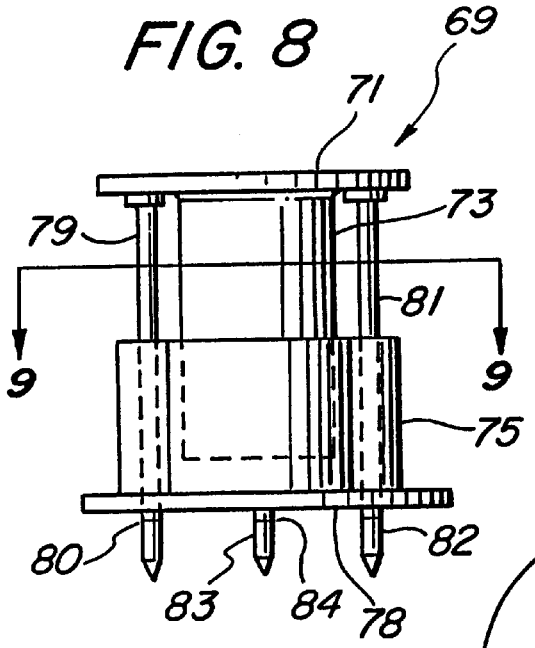
FIG. 8 is a side elevation of a threaded anchor for a wood form floor.
Figure 9:
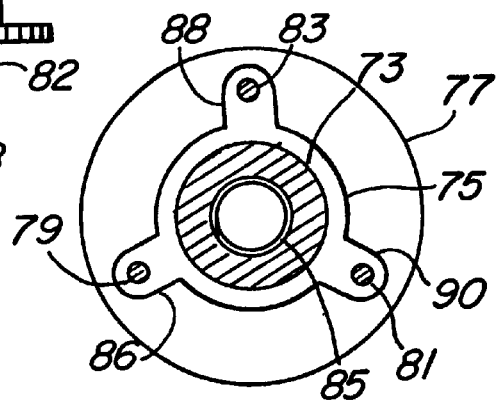
FIG. 9 is a cross-section taken along a line 9—9 of FIG. 8.
Figure 10:
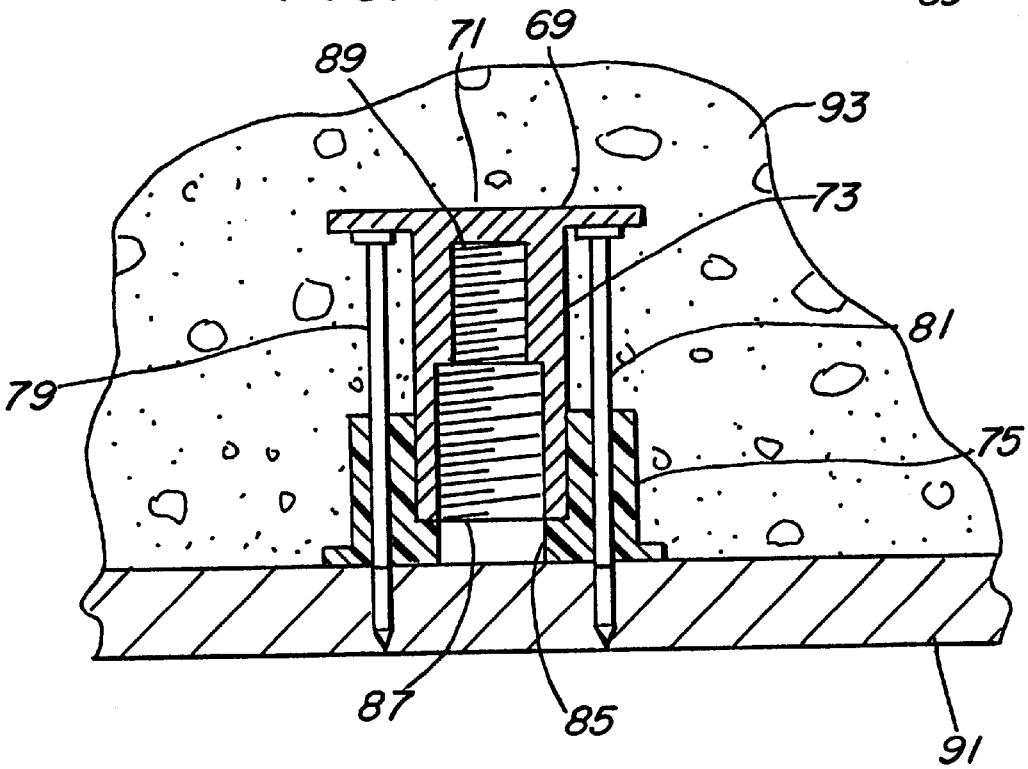
FIG. 10 is a vertical cross-section of the anchor of FIG. 8 in place after a concrete pour.

A second preferred embodiment for a threaded anchor for use with wood frame floors is shown in FIGS. 8, 9 and 10. The wood frame anchor 69 has a cylindrical shaft 73 with a large flat head 71 at a first end with an aperture 87 at its second end 78 which has a sleeve 75 firmly attached. The sleeve has a plurality of bosses 86, 88 and 90 extending therefrom with a flat plate 77 as its base. Each of the apertures 79, 81 and 83, through the respective bosses 86, 90 and 88, has a nail 79, 81 and 83 therethrough with their heads aligned with the first end of shaft 73 and the points align with the second end 78 of the threaded anchor 69. Each of the nails 79, 73 and 83 are scored with scribe line 80, 84 and 82, respectively at the protruding ends of the nails 79, 83 and 73. The function of these scribe lines will be described hereinafter.

Referring now to FIG. 10, concrete is poured over a wood base 91 which is removed after the poured concrete 93 has hardened. Prior to the concrete 93 being poured, the threaded anchors 69 are simply banged into the floor 91 by a hammer impact on head 71 which drives the nails into the wood floor 91. After the concrete pour 93 has been set, the wood form floor 91 is removed by striping it away, leaving the exposed nail ends extending below the bosses of sleeve 75. These can be easily broken off by a swipe of a hammer, for example, thereby eliminating the danger of the pointed ends extending from the ceiling with the potential of causing injury to anyone attempting to attach a threaded support rod to the anchor 69 now captured in the concrete floor 93.

FIG. 10 clearly illustrates the dual diameter internal threaded cavity of anchor 69. An internal thread cavity 89 having either a ⅜" or ⅝" diameter has a larger cavity 87 which opens to the second end of anchor 69 which may be ½" or ¾" in diameter.

The distance 85 between the open end of the threaded outer cavity 87 and the bottom 78 is important to prevent concrete from seeping into the internal threads when its in a liquid state during the pour.

What is claimed is:

1. Anchor insert for poured concrete metal deck floors, comprising:

a cylindrical shaft having a first end and a second end with a head at the first end, and a plurality of different internally threaded diameters extending from the second end;

a plate having an aperture therein sized for passing the shaft, located on the shaft along its length;

a plastic sleeve located on the shaft below the plate, having a first end and second end with collapsible fingers located at the first end and an aperture at the second end; and a spring located on the shaft between the head and the plate forcing the plate against the fingers on the sleeve.

2. The anchor insert of claim 1 wherein the cylindrical shaft has two internally threaded diameters, one for receiving a ⅝ inch diameter threaded bolt or rod, one for receiving a ¾ inch diameter threaded bolt or rod.

3. The anchor insert of claim 1 wherein the cylindrical shaft has two internally threaded diameters, one for receiving a ⅜ inch diameter threaded bolt or rod, one for receiving a ½ inch diameter threaded bolt or rod.

4. Anchor insert for poured concrete metal deck floors, comprising:

a shaft having a first end and a second end with a head at the first end, and a plurality of different internally threaded diameters extending from the second end; and a plate having an aperture therein sized for passing the shaft located on the shaft along its length for holding the shaft to the metal deck with the second end of the shaft passing through an aperture in the metal deck before the concrete is poured.

5. The anchor insert of claim 4 wherein the cylindrical shaft has two internally threaded diameters, one for receiving a ⅝ inch diameter threaded bolt or rod, one for receiving a ¾ inch diameter threaded bolt or rod.

6. The anchor insert of claim 4 wherein the shaft has two internally threaded diameters, one for receiving a ⅜ inch diameter threaded bolt or rod, one for receiving a ½ inch diameter threaded bolt or rod.

7. Anchor insert for a poured in place concrete floor using a wood form, said anchor insert comprising:

a shaft having a first end and a second end with a head at the first end, and a plurality of different internally threaded diameters extending for the second end;

a sleeve with a boss attached to the exterior of the shaft at its second end; and a plurality of nails, held by the boss on the sleeve, with the heads of the nails aligned to be underneath the head at the first end of the shaft.

8. The anchor insert of claim 7 wherein the shaft has two internally threaded diameters, one for receiving a ⅝ inch diameter threaded bolt or rod, one for receiving a ¾ inch diameter threaded bolt or rod.

9. The anchor insert of claim 7 wherein the shaft has two internally threaded diameters, one for receiving a ⅜ inch diameter threaded bolt or rod, one for receiving a ½ inch diameter threaded bolt or rod.

10. The anchor insert of claim 7 wherein each of the nails are scribed at a like distance from their pointed ends.

* * * * *